US006460960B1

(12) United States Patent
Mitsuhashi

(10) Patent No.: US 6,460,960 B1
(45) Date of Patent: Oct. 8, 2002

(54) METHOD FOR DRIVING INK JET HEAD

(75) Inventor: Tadashi Mitsuhashi, Tokorozawa (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/806,932

(22) PCT Filed: Jan. 18, 2000

(86) PCT No.: PCT/JP00/00198

§ 371 (c)(1),
(2), (4) Date: Apr. 6, 2001

(87) PCT Pub. No.: WO01/32428

PCT Pub. Date: May 10, 2001

(30) Foreign Application Priority Data

Oct. 29, 1999 (JP) ..... 11-308267

(51) Int. Cl.[7] ..... B41J 29/38
(52) U.S. Cl. ..... 347/11; 347/10
(58) Field of Search ..... 347/10, 11

(56) References Cited

U.S. PATENT DOCUMENTS 3,946,398 A 3/1976 Kyser et al. ..... 347/70
6,328,398 B1 * 12/2001 Chang ..... 347/1

FOREIGN PATENT DOCUMENTS

| | | | |
|---|---|---|---|
| EP | 0 812 689 A1 | 12/1997 | ..... B41J/2/045 |
| EP | 0 895 862 A1 | 10/1999 | ..... B41J/2/05 |
| JP | 62138589 | 6/1987 | ..... C10M/107/50 |
| JP | 9-141851 | 6/1997 | ..... B41J/2/045 |
| JP | 11-42775 | 2/1999 | ..... B41J/2/045 |
| JP | 11-268266 | 10/1999 | ..... B41J/2/045 |

* cited by examiner

*Primary Examiner*—John Barlow
*Assistant Examiner*—Alfred Dudding
(74) *Attorney, Agent, or Firm*—Finnegan, Henderson, Farabow, Garrett & Dunner, L.L.P.

(57) ABSTRACT

A method for driving an ink jet head is provided that achieves high-speed ejection of ink droplets without entailing satellite droplets. In driving the ink jet head to eject an ink droplet, first the driving voltage is lowered from its initial voltage value, then the driving voltage is rapidly raised to cause the meniscus to protrude outward, and the driving is stopped immediately after a main droplet is formed. In this condition, the driving voltage is lowered, thereby causing the meniscus to retreat and thus suppressing satellite ejection. Next, the driving voltage is raised to cause the meniscus to return to its initial position.

3 Claims, 6 Drawing Sheets

METHOD FOR DRIVING INK JET HEAD

TECHNICAL FIELD

The present invention relates to a method for driving a piezoelectric ink jet head which selectively deposits ink droplets onto an image recording medium.

BACKGROUND ART

Of nonimpact printers, printers based on ink jet technology are the simplest in principle and most suitable for color printing.

Among them, it can be said that the so-called drop-on-demand type that ejects ink droplets only when forming dots is predominant. Many types of drop-on-demand piezoelectric ink jet heads that use piezoelectric elements have been disclosed, representative examples including the Kyser type disclosed, for example, in Japanese Examined Patent Publication No. 53-12138, the multi-layer piezoelectric actuator type disclosed, for example, in Japanese Examined Patent Publication No. 68427, and the shear mode type disclosed, for example, in Japanese Unexamined Patent Publication No. 63-252750.

In such a piezoelectric ink jet head, a piezoelectric element deformable by the application of a pulse waveform is mounted at least on a portion of the wall surface of an ink chamber which communicates at one end with a nozzle and at the other end with an ink reservoir, and ink is ejected by deforming this piezoelectric element.

The piezoelectric ink jet head is usually driven in the following way. First, a pulse waveform is applied to the piezoelectric element to deform the portion of the wall surface of the ink chamber in such a manner as to cause the internal volume of the ink chamber to increase and thereby draw ink into the ink chamber. Next, by either removing the voltage from the piezoelectric element or applying a pulse waveform opposite in polarity to the first applied pulse waveform, the portion of the wall surface of the ink chamber is deformed in a direction opposite to the direction in which it was first deformed. This causes the internal volume of the ink chamber to decrease, and an ink droplet is ejected. This driving method is generally known as draw and eject.

However, the sudden drop in the internal volume of the ink chamber causes a sudden rise in the internal pressure of the ink chamber, and ink meniscus protrudes outwardly from the nozzle, forming an ink column, the ink column being caused to protrude further outward in the shape of an elongated rod. At this time, oscillations caused by the ejection of the ink droplet remains on the meniscus. On the other hand, the elongated ink droplet disintegrates into two independent droplets, i.e., a main droplet and a satellite droplet. The higher the ejection speed of the ink droplet, the shorter the time required to form the main droplet. This causes a displacement in time relative to the time that the ink droplet is cut off; the result of this is that the ink droplet is liable to become elongated. Accordingly, in the above driving method, if the ink ejection speed is increased, the ink droplet is liable to disintegrate. As a result, the ink droplet is deposited on the printing surface, not as a single dot but as a gourd-shaped dot or as two dots.

DISCLOSURE OF THE INVENTION

According to the ink jet head driving method of the present invention, only main droplets are ejected while the ejection of satellite droplets is prevented and a decrease in the ink ejection speed is avoided.

According to the ink jet head driving method of the present invention, in driving the ink jet head to eject an ink droplet, first the driving voltage is lowered from its initial voltage value, then the driving voltage is rapidly raised to cause the meniscus to protrude outward, and the driving is stopped immediately after a main droplet is formed. In this condition, the driving voltage is lowered, thereby causing the meniscus to retreat and thus suppress satellite ejection. Next, the driving voltage is raised to cause the meniscus to return to its initial position.

More specifically, the ink jet head driving method of the present invention ejects ink by deforming, using a piezoelectric actuator, at least a portion of a wall surface of an ink chamber which communicates at one end with a nozzle and at the other end with an ink reservoir.

According to the above driving method, in a first driving stage, a voltage applied to the piezoelectric actuator is lowered from an initial voltage value (VH), thereby driving the actuator to deform in a direction that increases the internal volume of the ink chamber and thus causing a meniscus in the nozzle to deflect toward the inside of the ink chamber.

Next, in a second driving stage, the piezoelectric actuator is driven to deform in a direction that reduces the internal volume of the ink chamber, thereby causing the meniscus in the nozzle to deflect toward the outside of the ink chamber and thus ejecting an ink droplet.

The second driving stage terminates when a main droplet is formed with the meniscus protruding outwardly from the ink chamber through the nozzle, wherein the driving voltage at that time is lower than the initial voltage value (VH).

Next, in a third driving stage, the piezoelectric actuator is driven to deform in the direction that increases the internal volume of the ink chamber, thereby causing the meniscus in the nozzle to deflect toward the inside of the ink chamber.

Further, in a fourth driving stage, the piezoelectric actuator is driven to deform in the direction that reduces the internal volume of the ink chamber, thereby causing the meniscus in the nozzle to deflect toward the outside of the ink chamber.

ADVANTAGEOUS EFFECT OF THE INVENTION

According to the present invention, it is possible to eliminate satellite droplets without decreasing the ejection speed of the main droplets. Since this serves to reduce the amount of ink deposited, high resolution printing can be achieved.

Furthermore, since the ejected ink droplet does not disintegrate, the printed ink droplet does not spread or flow if the spacing between the head and the recording medium becomes wider or if the feed speed of the head, etc. is increased. This increases the freedom in design in determining the spacing and the feed speed. Moreover, even when there is an appreciable step on the recording medium, since each ink droplet is printed as a single dot on the recording medium, no unevenness occurs in the printed result and a uniform print quality can be obtained.

DETAILED DESCRIPTION OF THE INVENTION

An ink jet head driving method according to the present invention will be described below by way of a specific embodiment.

Figure 1:
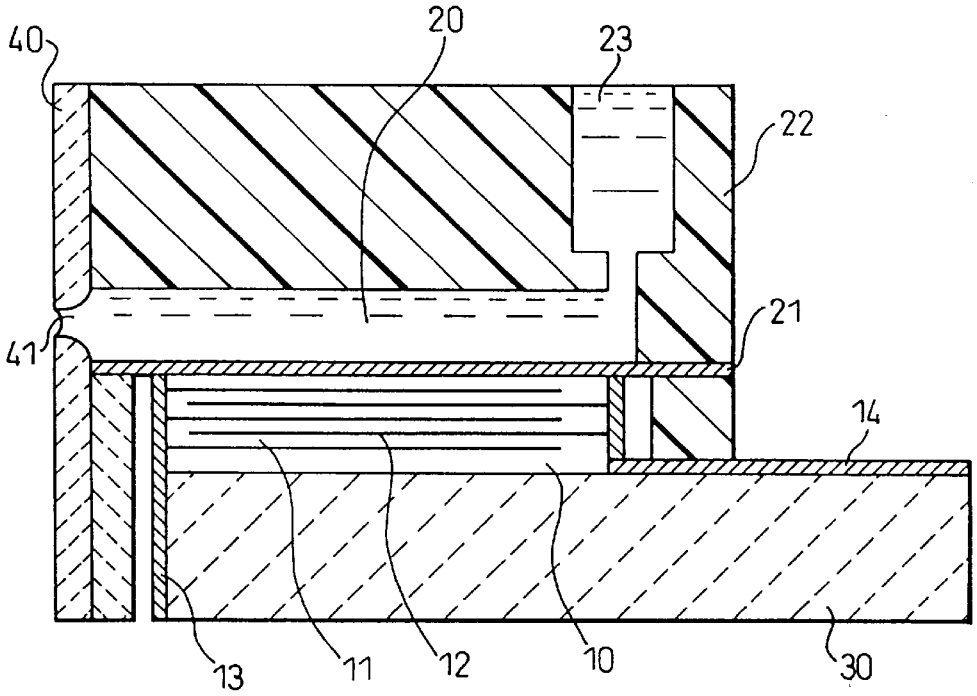
FIG. 1 is a cross-sectional side elevation view showing an embodiment of an ink jet head used in the present invention.
Figure 2:
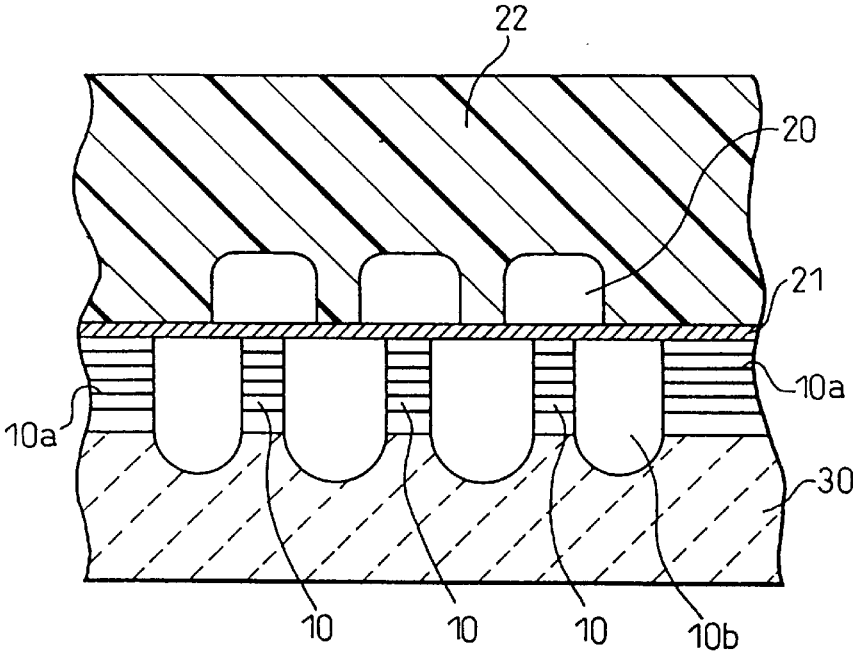
FIG. 2 is a cross-sectional front view of the ink jet head according to the embodiment of the present invention as viewed from the nozzle side thereof.

FIGS. 1 and 2 show the structure of an ink jet head to which the driving method of the present invention is applied. FIG. 1 illustrates a cross-sectional view of the ink jet head according to the present invention, and FIG. 2 presents a cross-sectional front view of the ink jet head according to the present invention as viewed from the nozzle side thereof.

The ink jet head includes multi-layer piezoelectric actuators 10, having a piezoelectric distortion constant d33, which are used to deform their associated ink chambers 20. More specifically, in the ink jet head, the piezoelectric actuators 10, each consisting of alternate layers of piezoelectric material 11 polarized in the thickness direction and conductive material 12, are glued to the upper surface of a substrate 30 and are spaced apart from another by a prescribed distance.

Collector electrodes 13 and 14 are respectively formed on the front and back end faces of each piezoelectric actuator 10. When a voltage is applied between the collector electrodes 13 and 14, the piezoelectric actuator 10 is deformed in its thickness direction (direction of d33).

A thin vibrating plate 21 is glued to the upper surface of the piezoelectric actuators 10, and a channel member 22 is glued to the upper surface of the vibrating plate 21. The ink chambers 20 are formed at uniformly spaced intervals in the channel member 22, the ink chambers 20 being disposed opposite their associated piezoelectric actuators 10 on the other side of the vibrating plate 21. Each ink chamber 20 has an ink supply port 23 which is connected to an ink cartridge (not shown) serving as an ink supply source.

The front end faces of the substrate 30 and piezoelectric actuators 10, with the collector electrode 13 formed thereon, the vibrating plate 21 and channel member 22 are made flush, and a nozzle plate 40 is glued to these end faces. A plurality of nozzle holes 41 are formed in the nozzle plate 40. These nozzle holes 41 communicate with the respective ink chambers 20 formed in the channel member 22. Accordingly, when ink from the ink cartridge is filled into an ink chamber 20, a meniscus is formed within its nozzle hole 41.

As shown in FIG. 2, the piezoelectric actuators 10 glued to the substrate 30 are formed by cutting grooves 10*b* using a wire saw or blade saw, and are disposed facing their associated ink chambers formed in the channel member 22. Piezoelectric actuators 10*a* are not activated but only serve as supports.

In the driving method of the present invention, each piezoelectric actuator 10 need only be driven to deform in such a manner as to rapidly increase or decrease the internal volume of its associated ink chamber 20. Therefore, the deformation mode of the piezoelectric actuator 10 is not limited to d33, but d31 may be used instead. Further, a plate-like unimorph or bimorph piezoelectric element may be used instead of the multilayer structure.

Next, the driving voltage waveform applied to the piezoelectric actuator 10 and the displacement of the piezoelectric actuator 10 will be described with reference to FIGS. 3 and 4.

Figure 3:
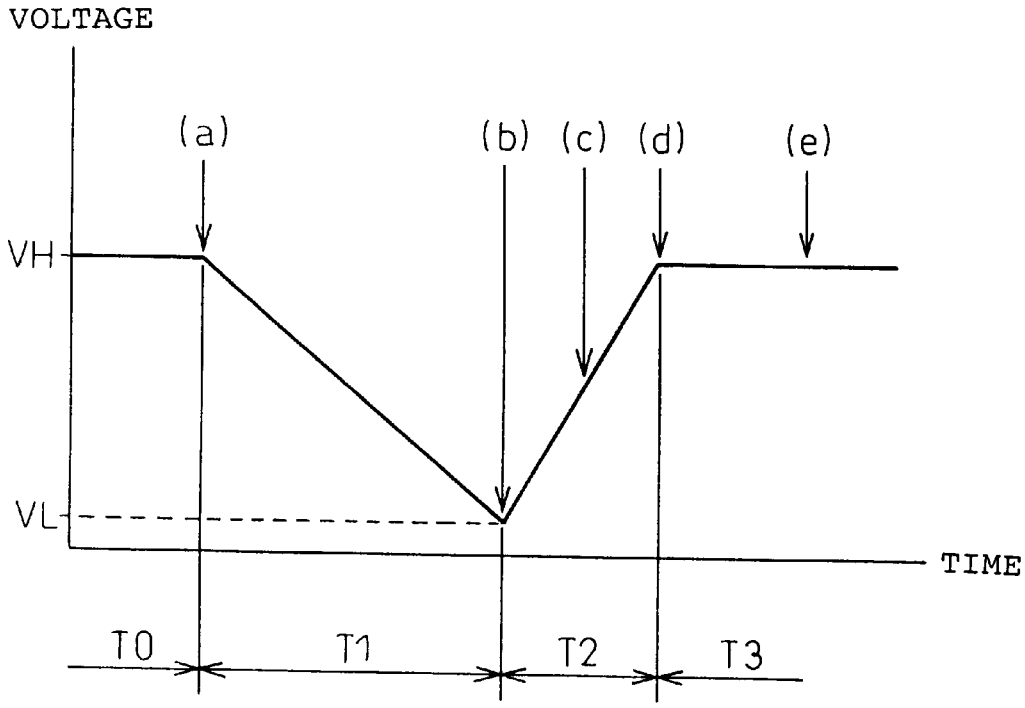
FIG. 3 is a diagram showing a driving waveform applied to a piezoelectric actuator according to the conventional art.

FIG. 3 is a diagram showing the driving voltage waveform applied to the piezoelectric actuator. FIG. 4 shows the motion of the meniscus observed at particular instants when the voltage waveform shown in FIG. 3 is applied to the piezoelectric actuator. The diagrams illustrate the phenomenon that occurs when an ink droplet is ejected at high speed.

As shown in FIG. 3, the driving voltage is held at its initial value VH during a first time period (TO). At this time, the piezoelectric actuator is deformed into its fully expanded state in the thickness direction, pushing up the vibrating plate and thus reducing the internal volume of the ink chamber to its minimum level. At time (a) in FIG. 3, the meniscus is slightly recessed toward the inside of the ink chamber and, in this state, an equilibrium condition is maintained as shown in FIG. 4(*a*).

Then, the driving voltage is lowered from its initial value VH to VL over a second time period (T1) as shown in FIG. 3. At this time, the piezoelectric actuator is deformed to contract in the thickness direction compared with its initial state, and the vibrating plate is pulled back in a direction that increases the internal volume of the ink chamber. As a result, the meniscus, at time (b) in FIG. 3, is pulled back toward the inside of the ink chamber as shown in FIG. 4(*b*).

Next, the driving voltage is rapidly raised in a short third time period (T2) as shown in FIG. 3. At this time, the piezoelectric actuator expands in the thickness direction, and the vibrating plate is pushed up, moving in a direction that rapidly reduces the internal volume of the ink chamber. The rapid reduction in the internal volume of the ink chamber causes a rapid increase in the internal pressure of the ink chamber. As a result, the meniscus, at time (c) in FIG. 3, protrudes outwardly from the nozzle hole and begins to form an ink column as shown in FIG. 4(*c*).

Figure 4:
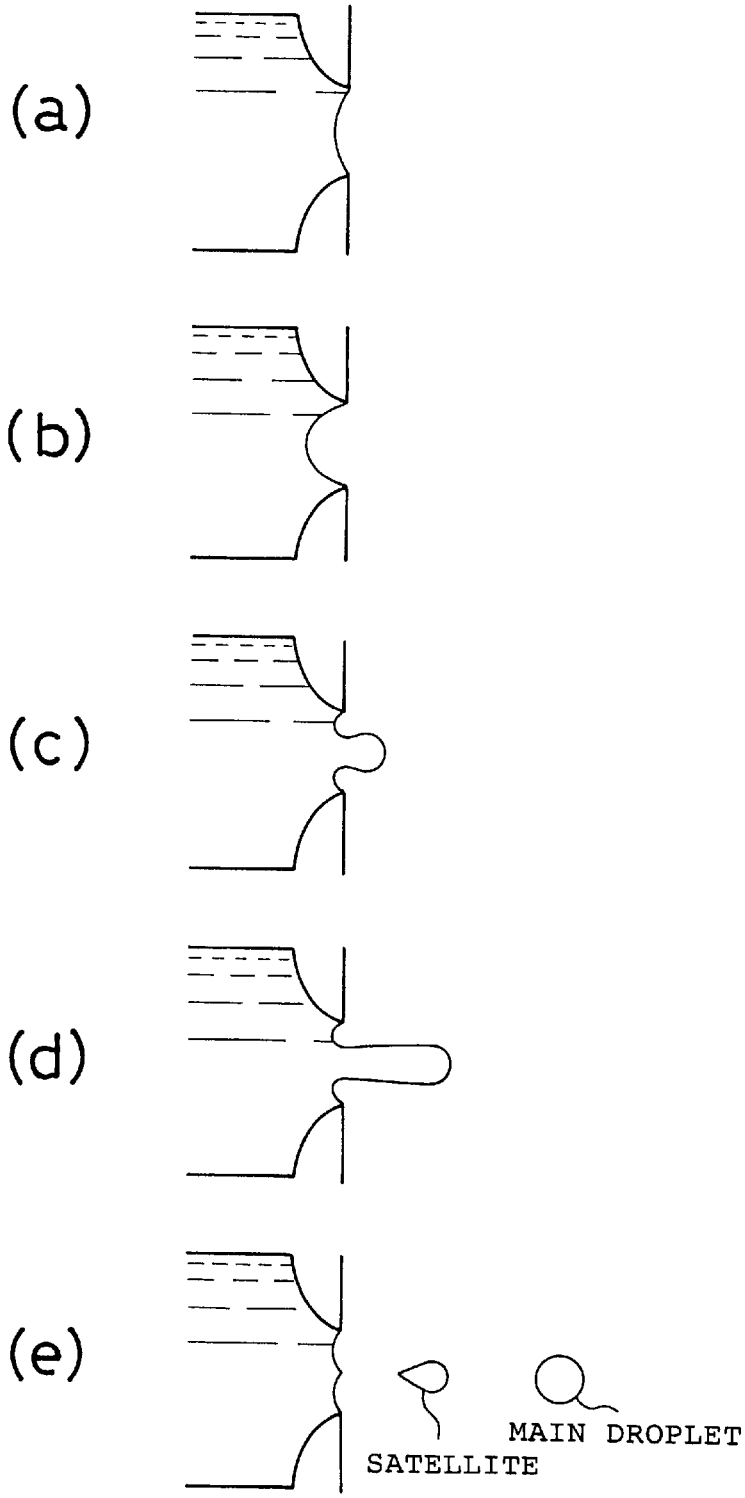
FIG. 4 is a diagram illustrating the motion of a meniscus in a nozzle hole when a conventional ink jet head driving method is employed.

At time (d) in FIG. 3, the meniscus protrudes further outward compared with the state in the preceding stage (c) and is formed into an elongated shape as shown in FIG. 4(*d*). This phenomenon occurs because the driving voltage continues to rise throughout the third time period (T2) till the time (d) and the piezoelectric actuator thus continues to expand in its thickness direction past the time (c), causing the internal volume of the ink chamber to further reduce.

Then, the driving voltage is held at its initial value VH during a fourth time period (T3) as shown in FIG. 3. At this time (e), the oscillations caused by the ejection of an ink droplet remain on the meniscus as shown in FIG. 4(*e*). On the other hand, the ink droplet, when ejected, disintegrates into two independent droplets, a main droplet and a satellite droplet.

A requirement for accomplishing the ejection of an ink droplet is that the ejected ink droplet should be cleanly cut off as it leaves the nozzle hole. The cut-off of the ink droplet depends more or less on the intrinsic surface tension of the ink and the meniscus surface tension oscillations that the nozzle hole exhibits. Accordingly, it takes a finite time to complete the cut-off of the ink droplet.

On the other hand, the higher the ink ejection speed, the shorter the time required to form the main droplet. However, because of the surface tension of the ink, it takes a finite time to cut off the ink droplet. This results in a displacement between the time that the main droplet is formed and the time that the ink droplet is cut off; since the main droplet continues to protrude outward during this time period, the ink droplet tends to be elongated.

Furthermore, since the tail of the protruding ink droplet is pulled toward the nozzle as the meniscus is pulled back to cut off the ink droplet, there occurs a velocity difference between the tail and the protruding end of the ink droplet. This velocity difference causes the elongated ink droplet to further elongate. This coupled with the surface tension of the ink itself causes the elongated ink droplet to disintegrate into the main droplet and the satellite droplet.

If the speed of the ink droplet ejected by the above method is increased, the ejected ink droplet tends to fly out as disintegrated droplets. In this case, the ejected droplet may be deposited on the printing surface in the form of a gourd-shaped dot or two separate dots, depending on the distance between the nozzle and the printing surface and the moving speed of the head. Accordingly, if each pixel is to be printed as a single dot, there occurs the limitation that the moving speed of the head or paper cannot be increased, nor can the spacing between the head and the recording medium be increased.

In view of this, the present invention is intended to provide an ink jet head driving method that can produce only main droplets while preventing the formation of satellite droplets and without reducing the ink ejection speed.

Figure 5:
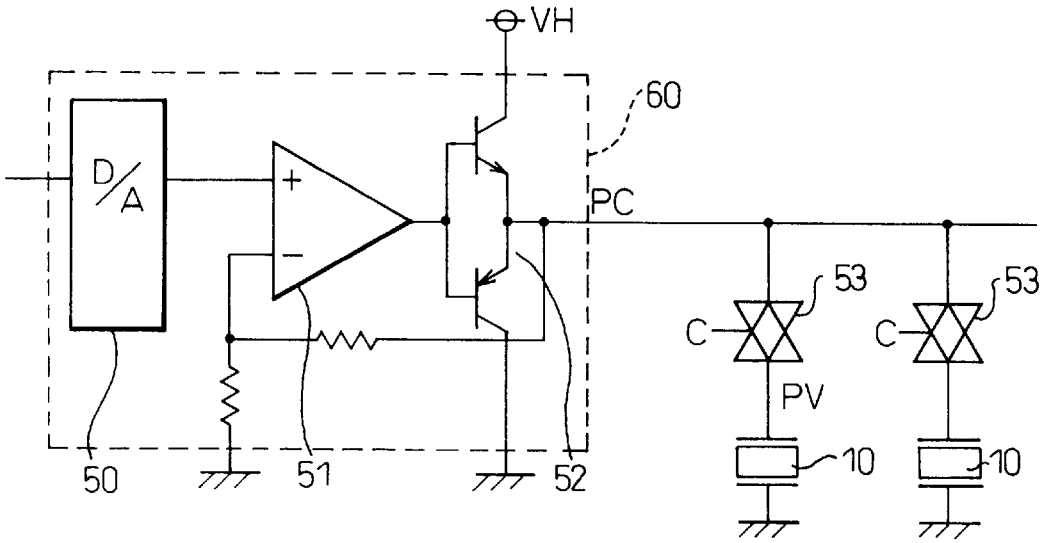
FIG. 5 is a diagram showing a driving circuit for implementing a method of driving the ink jet head used in the present invention.

FIG. 5 is a diagram showing the configuration of a driving circuit used in the method of the present invention to apply voltage to the piezoelectric actuators 10 in the ink jet head.

The driving circuit comprises: a driving waveform generating circuit 60 consisting of a D/A converter 50, an operational amplifier 51, and a current amplifying transistor 52; transfer gates 53; and the piezoelectric actuators 10.

In the driving waveform generating circuit 60, first the D/A converter 50 generates the basic driving voltage waveform, which is current-amplified by the operational amplifier 51 and output from the current amplifying transistor 52.

The common driving waveform signal PC output from the driving waveform generating circuit 60 is coupled to each transfer gate 53 whose ON/OFF operation is controlled by a control signal C. When the transfer gate 53 is ON, the driving voltage waveform is controlled for application to the associated piezoelectric actuator 10 which is thus caused to deform.

Figure 6:
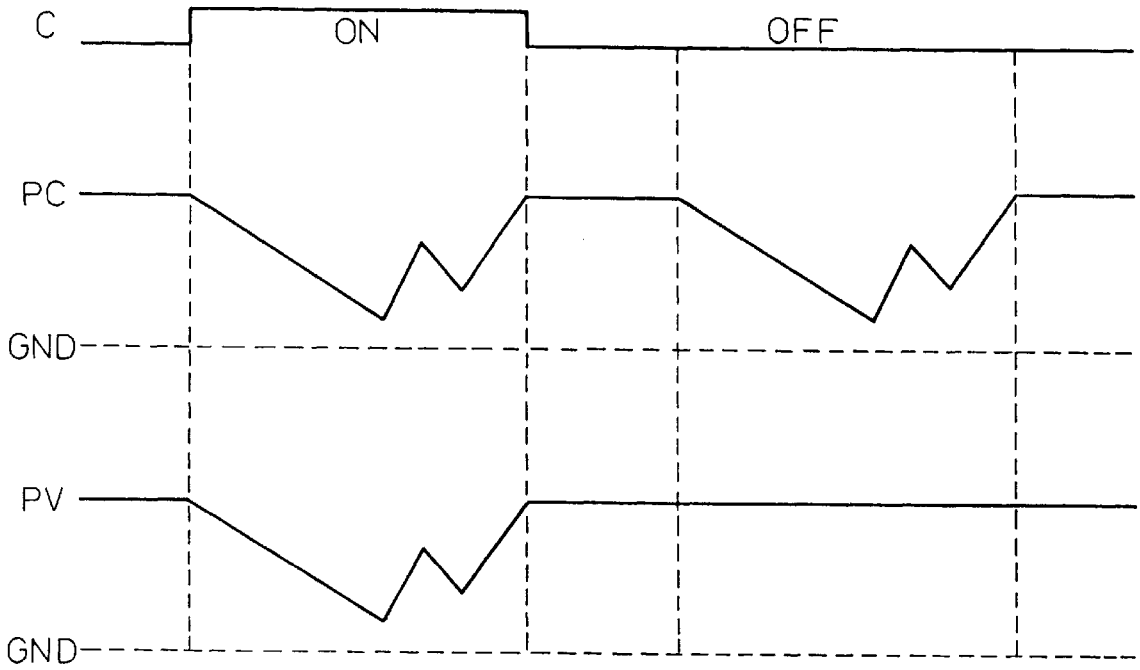
FIG. 6 is a diagram showing voltage waveforms at various parts of the driving circuit of FIG. 5.

FIG. 6 shows voltage waveforms at various parts of the driving circuit shown in FIG. 5. C is the control signal for controlling the ON/OFF operation of each transfer gate, and PC is the common driving voltage waveform output from the driving voltage waveform generating circuit 60. PV is the driving voltage waveform applied to the piezoelectric actuator 10 when the control signal C is ON.

Figure 7:
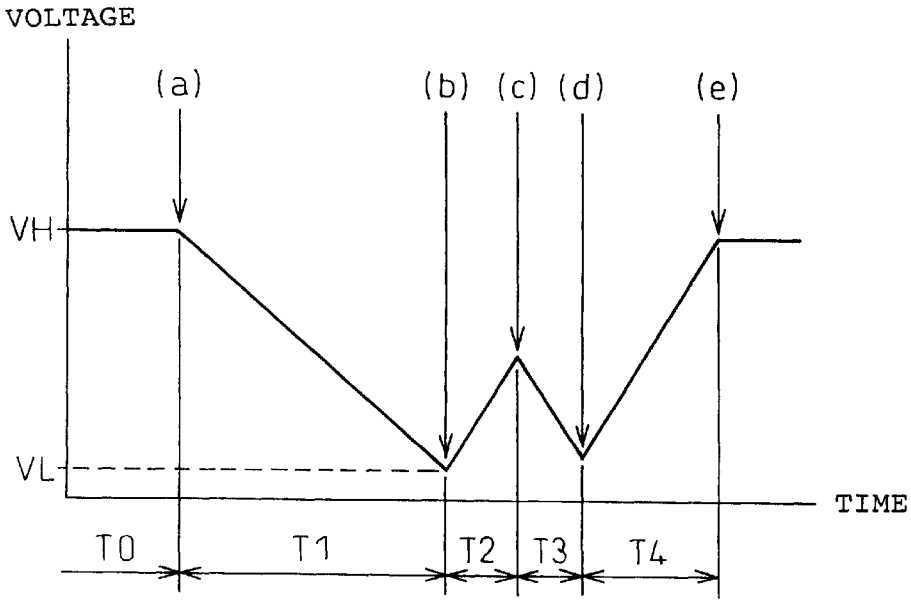
FIG. 7 is a diagram showing a driving waveform applied to a piezoelectric actuator in the ink jet head according to the present invention.
Figure 8:
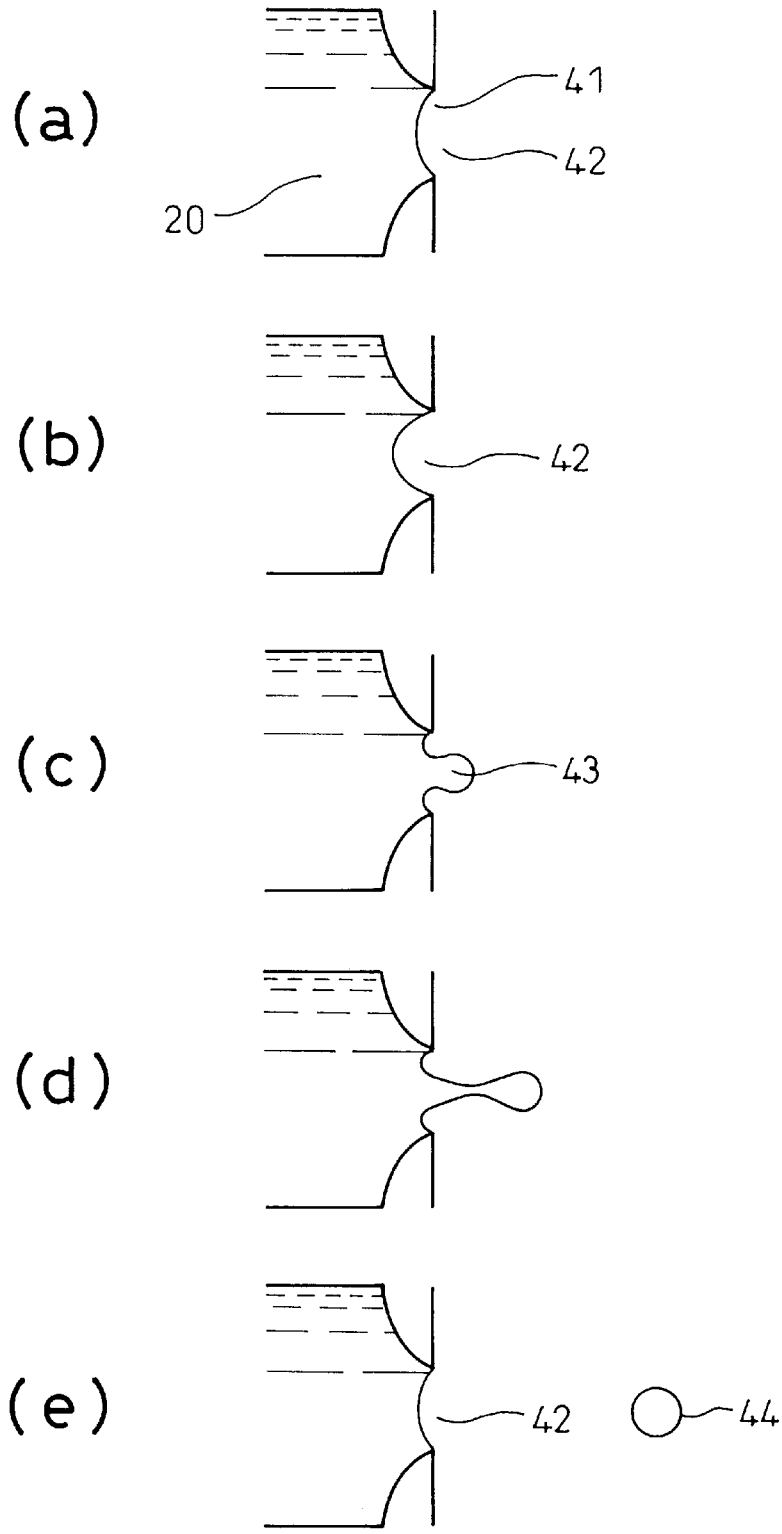
FIG. 8 is a diagram illustrating the motion of the meniscus in the nozzle hole when the ink jet head driving method of the present invention is employed.

Next, the ink jet head driving method of the present invention will be described with reference to FIGS. 7 and 8. FIG. 7 shows the driving waveform applied to the piezoelectric actuator of the present invention when the ink jet head and the driving waveform circuit described above are used. FIG. 8 shows the motion of the meniscus at particular instants when the driving voltage shown in FIG. 7 is applied to the piezoelectric actuator.

As shown in FIG. 7, the value of the driving voltage is held at VH during a first time period (TO). At this time, the piezoelectric actuator is deformed into its fully expanded state in the thickness direction. As a result, the vibrating plate is pushed up, reducing the internal volume of the ink chamber 20 to its minimum level. At time (a) in FIG. 7, the meniscus 42 is slightly recessed toward the inside of the ink chamber and, in this state, an equilibrium condition is maintained as shown in FIG. 8(*a*).

Then, the driving voltage is lowered form VH to VL over a second time period (T1) as shown in FIG. 7. At this time, the piezoelectric actuator is deformed to contract in the thickness direction compared with its initial state. As a result, the vibrating plate is pulled back to its initial position, moving in the direction that increases the internal volume of the ink chamber. Thus, at time (b) in FIG. 7, the meniscus is pulled back toward the inside of the ink chamber as shown in FIG. 8(*b*). The pull amount of the meniscus can be adjusted by controlling the amount and duration of the voltage drop in this driving stage, so that the amount of ejection of the ink droplet 44, described later, can be controlled to an optimum value.

Next, the driving voltage is rapidly raised in a short third time period (T2) as shown in FIG. 7. At this time, the piezoelectric actuator expands in the thickness direction. As a result, the vibrating plate is pushed up, moving in the direction that reduces the internal volume of the ink chamber. This causes the internal pressure of the ink chamber to increase rapidly; at time (c) in FIG. 7, the meniscus 42 protrudes outwardly from the nozzle hole and begins to form an ink column 43, as shown in FIG. 8(*c*), to produce a main droplet.

The raising of the driving voltage is stopped when the main droplet is formed, and then the driving voltage is lowered over a fourth time period (T3) as shown in FIG. 7. The driving voltage during this period is lower than the initial voltage (VH). At this time, the piezoelectric actuator is deformed to contract in the thickness direction. As a result, the vibrating plate is pulled back, moving in the direction that increases the internal volume of the ink chamber. The ink column 43 which began to form in the preceding stage now begins to be cut off at the properly protruded position. At time (d) in FIG. 7, the meniscus 42 is pulled back toward the inside of the ink chamber as shown in FIG. 8(*d*). The result is the formation of the ink droplet 44 which is ejected as the main droplet.

Next, the driving voltage is raised over a fifth time period (T4) as shown in FIG. 7. At this time, the piezoelectric actuator is deformed to expand in the thickness direction. As a result, the vibrating plate is pushed up, moving in the direction that reduces the internal volume of the ink chamber. Thus, the meniscus that was pulled back in the preceding stage is quickly returned to its initial position while performing control to prevent the meniscus from being pulled back too far. At time (e) in FIG. 7, the meniscus 42 returns to its initial position as shown in FIG. 8(*e*), ready for the next driving. On the other hand, the ink droplet 44 formed as the main droplet is on its way to the printing surface.

What is claimed is:

1. A method for driving an ink jet head in which at least a portion of a wall surface of an ink chamber communicating at one end with a nozzle and at the other end with an ink reservoir is deformed by a piezoelectric actuator to eject ink, comprising:

a first driving stage in which a voltage applied to said piezoelectric actuator is lowered from an initial voltage value (VH), thereby driving the actuator to deform in a direction that increases the internal volume of the ink chamber and thus causing a meniscus in the nozzle to deflect toward the inside of the ink chamber;

a second driving stage in which the piezoelectric actuator is driven to deform in a direction that reduces the internal volume of the ink chamber, thereby causing the meniscus in the nozzle to deflect toward the outside of the ink chamber and thus ejecting an ink droplet, and wherein:

the second driving stage terminates when a main droplet is formed with the meniscus protruding outwardly from the ink chamber through the nozzle, wherein the driving voltage at that time is lower than the initial voltage value (VH); and a third driving stage in which after the second driving stage terminates, the piezoelectric actuator is driven to deform in the direction that increases the internal volume of the ink chamber, thereby causing the meniscus in the nozzle to deflect toward the inside of the ink chamber.

2. A method for driving an ink jet head as claimed in claim 1, further comprising a fourth driving stage in which after the third driving stage terminates, the piezoelectric actuator is driven to deform in the direction that reduces the internal volume of the ink chamber, thereby causing the meniscus in the nozzle to deflect toward the outside of the ink chamber.

3. A method for driving an ink jet head as claimed in claim 2, wherein in the fourth driving stage, the voltage applied to the piezoelectric actuator is raised to the initial voltage value (VH).

* * * * *